US009518482B2

(12) United States Patent
Pelfrey et al.

(10) Patent No.: US 9,518,482 B2
(45) Date of Patent: Dec. 13, 2016

(54) INTERNAL COMBUSTION ENGINE

(71) Applicants: Riley Dale Pelfrey, The Villages, FL (US); Rick Dean Pelfrey, Bellbrook, OH (US); Jared Brewer, Centerville, OH (US); Seule Kabir, Kettering, OH (US)

(72) Inventors: Riley Dale Pelfrey, The Villages, FL (US); Rick Dean Pelfrey, Bellbrook, OH (US); Jared Brewer, Centerville, OH (US); Seule Kabir, Kettering, OH (US)

( * ) Notice: Subject to any disclaimer, the term of this patent is extended or adjusted under 35 U.S.C. 154(b) by 242 days.

(21) Appl. No.: 14/293,635

(22) Filed: Jun. 2, 2014

(65) Prior Publication Data

US 2015/0345406 A1 Dec. 3, 2015

(51) Int. Cl.

| | |
|---|---|
| ***F01L 1/46*** | (2006.01) |
| ***F01L 1/047*** | (2006.01) |
| ***F01L 1/26*** | (2006.01) |
| ***F01L 1/28*** | (2006.01) |
| ***F01L 7/06*** | (2006.01) |
| ***F01L 7/14*** | (2006.01) |
| ***F01L 7/18*** | (2006.01) |
| *F01L 3/00* | (2006.01) |

(52) U.S. Cl.

CPC ..... *F01L 1/047* (2013.01); *F01L 1/26* (2013.01); *F01L 1/285* (2013.01); *F01L 7/06* (2013.01); *F01L 7/14* (2013.01); *F01L 7/18* (2013.01); *F01L 3/00* (2013.01)

(58) Field of Classification Search

CPC ..... F01L 1/44; F01L 7/14; F01L 1/446; F01L 1/443

USPC ..... 123/190.2

See application file for complete search history.

(56) References Cited

U.S. PATENT DOCUMENTS

| | | | | |
|---|---|---|---|---|
| 1,951,759 | A * | 3/1934 | Keister | F01L 1/28 123/79 R |
| 2,107,389 | A | 2/1938 | Price | |
| 2,791,992 | A | 5/1957 | Robinson | |
| 4,075,986 | A | 2/1978 | Keck | |
| 5,081,961 | A * | 1/1992 | Paul | F01L 1/28 123/190.11 |
| 5,331,929 | A | 7/1994 | Plantan | |
| 5,572,967 | A * | 11/1996 | Donaldson, Jr. | F01L 1/344 123/190.12 |
| 8,677,955 | B2 | 3/2014 | Rickenbach | |
| 2015/0176548 | A1* | 6/2015 | Schroder | F16K 11/0525 123/190.2 |

* cited by examiner

*Primary Examiner* — Jorge Leon, Jr.
(74) *Attorney, Agent, or Firm* — R. William Graham

(57) ABSTRACT

This invention presents a method to improve the volumetric efficiency of a reciprocating internal combustion engine using a common transfer port between the exhaust and intake port. The engine employs a poppet valve as part of the intake and exhaust valve to control the flow from the transfer port into the combustion chamber. Two plate type valves outside of the combustion chamber are located at both ends of the transfer port to control the flow coming from the intake and out the exhaust. The timing for opening and closing of the poppet type valve is regulated to remain open for a longer duration which provides complete evacuation of air in the exhaust stroke. The ejector effect from the exhaust flow through the transfer port draws a vacuum into the cylinder. When the exhaust plate closes, the vacuum diverts the intake into the cylinder.

10 Claims, 6 Drawing Sheets

INTERNAL COMBUSTION ENGINE

BACKGROUND OF INVENTION

This invention relates to internal combustion engines and more particularly to an improvement in valve mechanism to direct intake and exhaust flow in and out of the engine.

Poppet type valves are most widely used valves to open and close combustion chamber. A conventional engine uses at least two individual poppet valves, one for the intake and another for exhaust, to control the engine gas exchange process. They operate in timed relation to the rotation of the engine crank shaft. Other types of valves such as rotary or sleeve valves, and in some instance a single poppet valve is also used to control the flow. There are advantages and disadvantages with any of these systems. Obtaining a positive sealing for the rotary and sleeve type valve for different speed range is still a challenge. Poppet type valves ensure positive sealing, however when individual poppet valve is used for intake and exhaust, it reduces the size of the gas passage, increases weight, and requires more energy to drive, to name a few. The use of single poppet valve is advantageous from the aspect of lightness and simplicity of construction, valve temperature control, and combustion chamber design.

The idea of an internal combustion engine having a single poppet type valve to control intake and exhaust flow of the combustion chamber is very well recognized. It dates back to as early as Jun. 16, 1895, U.S. Pat. No. 5,428,46 to Diesel, to the present time Pub. Date. Jul. 7, 2011, Pub. No. US2011/0162607 A1 to Joel et al. Most of these inventions are adaptable for use under constant speed condition where it is not necessary to control the intake and exhaust flow and timing in relation to the speed change. A few of the inventions, such as U.S. Pat. No. 2,107,389 and U.S. Pat. No. 40,755,986, provide mechanics to control the intake and exhaust flow before they enter the combustion chamber through the poppet valve. However, the intake timing and the size of gas flow passage directly depends on the timing and the size of the exhaust, hindering the optimization of valve timing. There are other limiting factors of single poppet type valve, such as the placement of the spark plug and the fuel injector system using conventional poppet type valves.

It is therefore an object of the invention to provide a combination of poppet type and unique plate type of valve system to minimize drawbacks of a current valve system and improve upon it.

Another object of our invention is to provide scavenging of the intake flow and simultaneously provide cooling of the poppet valve and the exhaust means, employing a common air chamber.

A further object of our invention is to provide a poppet type valve engine which is mechanically similar to standard practice and thus variable valve timing can be employed.

It is a general object of the present invention to improve internal combustion engine design.

SUMMARY OF INVENTION

The invention involves internal combustion engine, generally characterized by two-stroke or four-stroke principle, comprising intake, compression, power, and exhaust cycle of operation. The engine includes a piston cylinder having a combustion chamber and a piston mounted therein sealingly engaged with the walls of the combustion chamber. Air and combustible fuel, such as gasoline or diesel, are drawn into or injected into the combustion chamber, commonly known as intake. The charged combustible mixture is compressed by the piston and ignited, known as compression and power. Once energy is extracted from the combust mixture, a valve between the combustion chamber and the exhaust path opens to release the products of combustion out of the combustion chamber, known as exhaust.

With this innovation, both the intake and exhaust gas exchange process of the combustion chamber is collectively controlled using poppet type valves. A single poppet type valve on top of the combustion chamber permits larger gas passage area and a better intake swirl for better combustion characteristic. When it is desired to place the spark plug of spark ignition engine or the fuel injector of diesel engine on top of the combustion chamber, more than one poppet valve can be used where they all open and close collectively to control the gas exchange of the combustion chamber. In a single poppet type valve engine configuration the spark plug or the fuel injector can be placed through the center of the poppet using modified poppet valve to position them on top of the combustion chamber.

For both combustion chamber designs, a common transfer port adjacent to the combustion chamber communicates between the chamber and the intake and exhaust ducts, which are communicably aligned with the transfer port. A rotary or reciprocating plate type valve opens and closes the intake and exhaust ducts to and out from the transfer port in order to guide the gas flow. According to the innovation in an embodiment, the plates operate with sufficient mechanical clearance so no lubrication is required.

During the normal combustion process, the exhaust plate valve opens to allow the exhaust gases to escape at the end of power stroke. Then the poppet valve system open to allow the cylinder gases to exhaust into the transfer port and then out past the exhaust plate. At the end of the exhaust cycle, the poppet valve remains open and the intake plate opens to allow the exhaust to fully evacuate. The ejector effect caused by the intake air flow through the transfer port to the exhaust plate will draw a vacuum inside the cylinder. The exhaust plate closes and diverts the intake air into the cylinder.

Accordingly, one embodiment is directed to a flow control mechanism for an internal combustion reciprocating piston engine. The engine includes a combustion chamber, a common transfer port adjacent to the combustion chamber, an intake duct directly communicating with the transfer port and an exhaust duct extending out from the transfer port to communicate flow into and out of the transfer port, a first valve positioned inside the combustion chamber for controlling flow between the transfer port and the combustion chamber, a second valve for controlling flow between the intake duct and the transfer port, and a third valve for controlling flow between the exhaust duct and the transfer port, wherein the second valve and the third valve are independently controlled.

Other objects and features of the invention will be more fully understood from reading the drawings and description hereinafter.

DETAILED DESCRIPTION

The following detail description with appended drawings helps explain the invention further. Same numerals present identical elements of the embodiments. Terms such as top, bottom, horizontally and vertically describes an orientation relative to the drawings only and do not necessarily correspond to an actual engine plane in which these parts may be incorporated.

Figure 8:
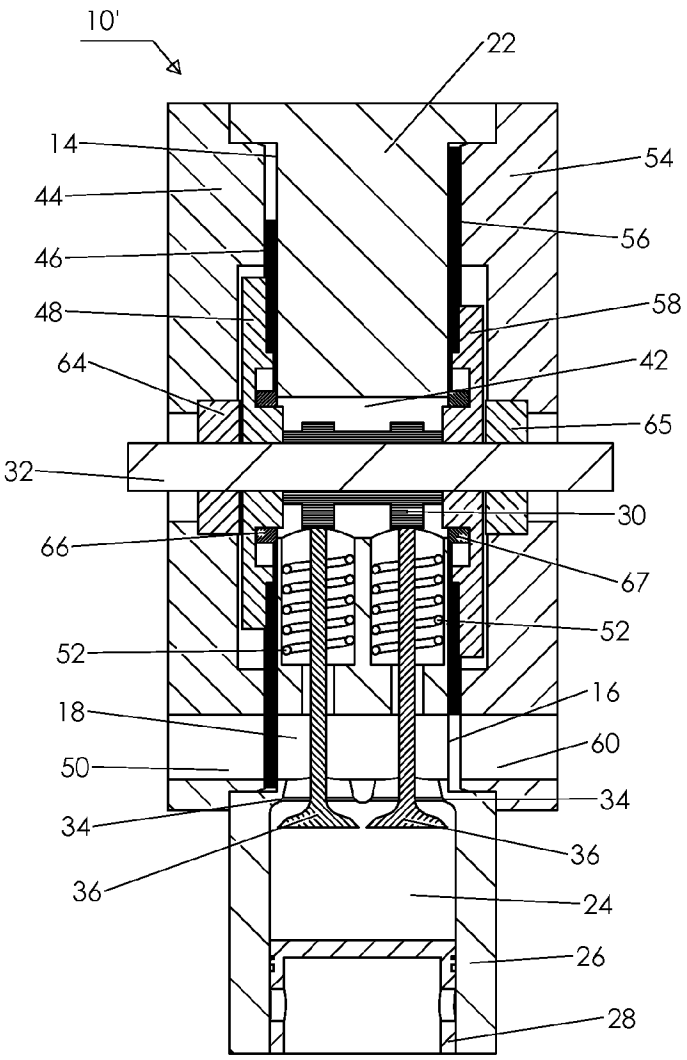
FIG. 8 shows another exemplary configuration of the combustion chamber with multiple poppet valves.
Figure 10:
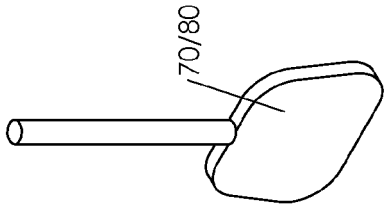
FIG. 10 shows an exemplary configuration of the reciprocating plate valve.
Figure 11:
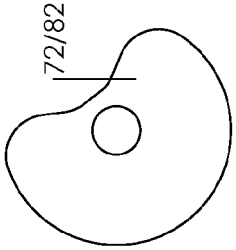
FIG. 11 is a side view of an exemplary cam configuration to actuate the reciprocating plate valve.
Figure 9:
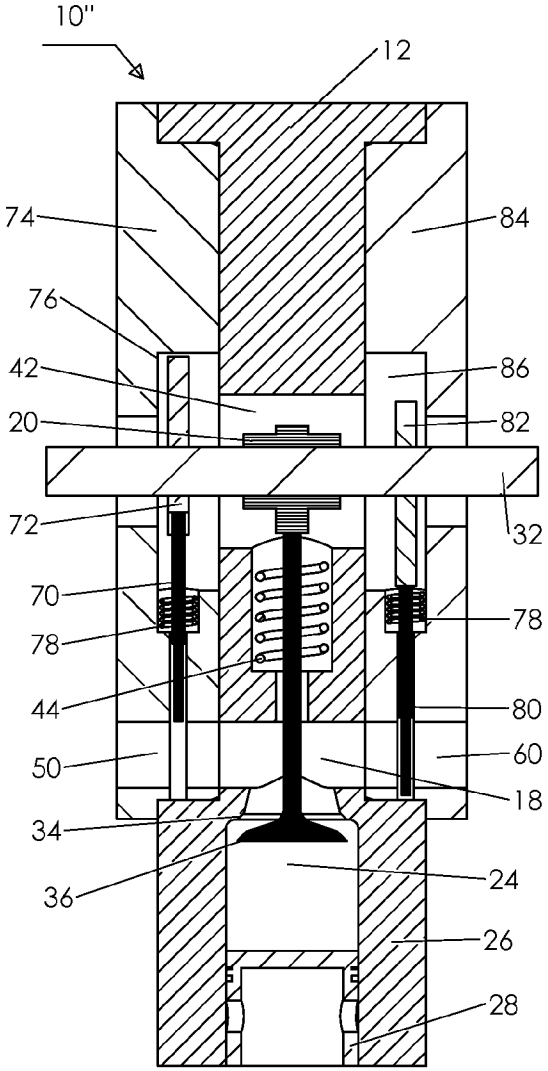
FIG. 9 is a cross section view similar to FIG. 1 showing substitute modification of the rotating plate valve mechanism with an exemplary reciprocating plate valve mechanism.

Referring to the drawings, a first embodiment of an internal combustion engine of the invention is seen in FIGS. 1-6 and is generally designated by the numeral 10. A second embodiment the engine of invention is seen in FIG. 8 and is designated by the numeral 10'. A third embodiment the engine of invention is seen in FIG. 9-11 and is designated by the numeral 10". For the present invention, engine frame and crank shaft structures are conventional and therefore not shown. Unique aspects of the invention reside the engine head structure which incorporates an unconventional structure and method to control the intake and exhaust flow in and out of the engine 10, 10', and 10".

The engine 10 includes a central valve housing member 12 having a recessed intake face 14 and a recessed exhaust face 16. A non-centrally disposed transverse port 18 extends from the intake face 14 to the exhaust face 16 of the central valve housing member 12. A piston cylinder 26 is positioned within the central valve housing member 12 and operably in communication with transfer port 18. Upper end of the cylinder 26 forms a combustion chamber 24 inside which combusted fuel discharges in a conventional systems. A reciprocating piston 28 is operably disposed in the cylinder 26.

The combustion chamber 24 is opened and closed to the transfer port 18 by means of a single poppet valve 36 constructed with a head 38 and a shaft 40. The valve head 38 seats against a valve seat 34 in the piston cylinder 26. In accordance with the invention, the poppet valve 36 opens and closes the combustion chamber 24 by means of a cam 20 in operable connection with shaft 40 and stays close throughout combustion and power stroke by means of a spring 52 connected to the shaft 40 of the poppet valve 36. A central transverse opening 42 extends from the intake face 14 through to the exhaust face 16 of the housing 12 and serves to receive a cam shaft 32 and sealed using sealing element 66 and 67 connected to hub 64 and 65, respectively. It is to be understood that the poppet valve 36 can be actuated using means other than a spring and cam mechanism such as desmodromic, solenoid, or electrical actuation.

Figure 2:
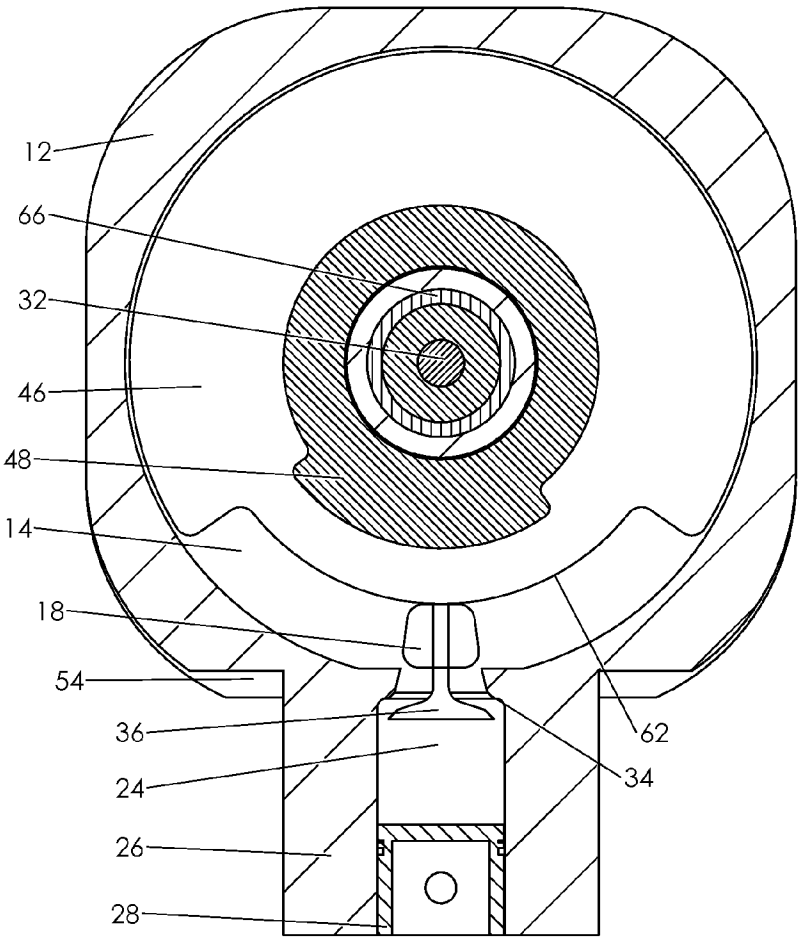
FIG. 2 is a section view along the line L1 of FIG. 1 showing the prototypical valve plate and poppet valve position in relation to the transfer port and combustion chamber.
Figure 1:
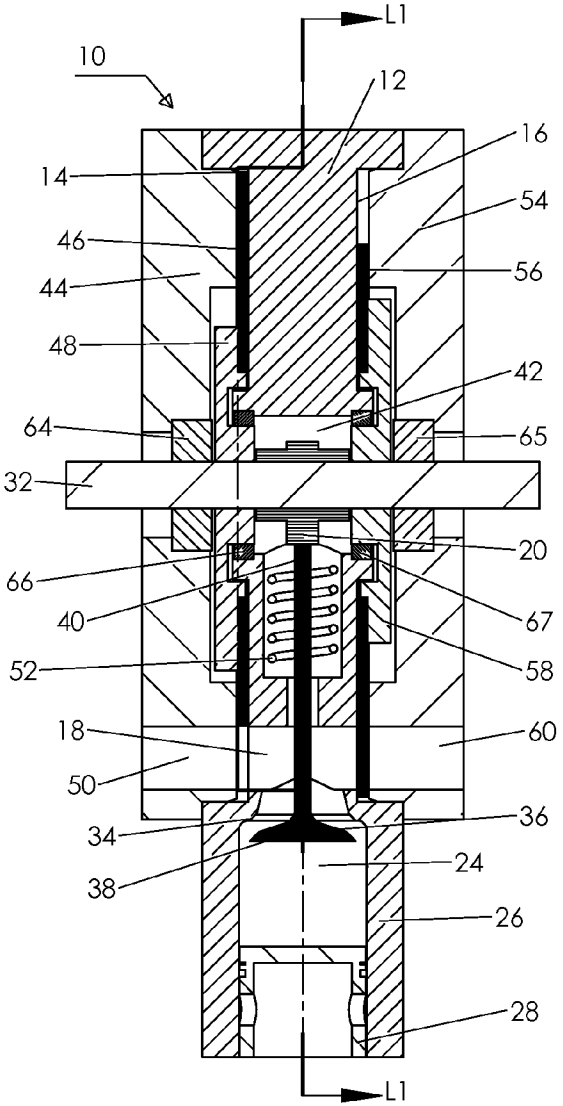
FIG. 1 is the sectional view of a prototypical poppet valve, cam, plate valves, and drive system mounted within a prototypical housing according to the instant invention.
Figure 3:
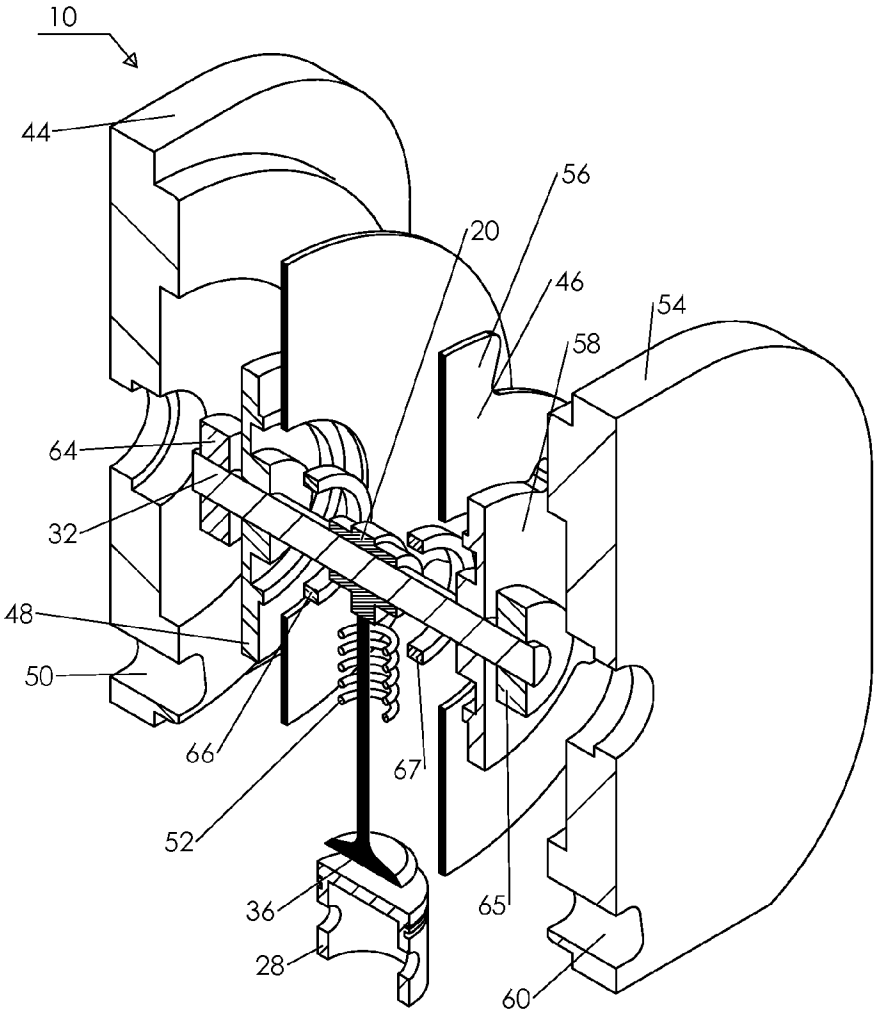
FIG. 3 shows an exploded view of FIG. 1 without the housing.
Figure 5:
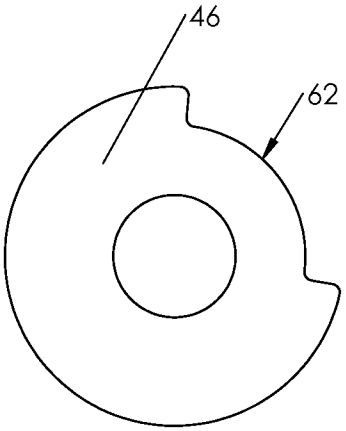
FIG. 5 is a side view of the prototypical valve plate configuration.

Two separate rotary plate valves of similar structure, intake plate valve 46 and exhaust plate valve 56, control the intake and exhaust flow through the transfer port 18. In the rotary form, the semicircular plate valves 46 and 56 are preferably thin and lightweight, and have a radial peripheral opening 62 and 63 (FIG. 4), respectively, to communicate with the transfer port 18 as seen in FIG. 2. The plate valves 46 and 56 are mounted on the camshaft 32 using two rotary hubs, intake rotary hub 48 and exhaust rotary hub 58. The cam shaft 32 and the hubs 48 and 58 can include complementary keyed structure to maintain relationship to the cam 20. This also helps to prevent single valve rotation due to vibration. In this configuration, the axis of rotation of the plate valves 46 and 56 is in the same line with the axis of rotation of the cam 20. A mechanical or electrical mechanism can be incorporated into the hubs 48 and 58, to change the timing of the intake plate 46 and exhaust plate 56 in accordance with timing of the poppet valve 36. Other structures are contemplated to adjust or set the timing of operation of the engine. Changing the timing based on the speed of the engine or other sensor controls can improve efficiency of the engine. For example, a centrifugal mechanism can be used to the change the plate timing as the engine speed changes. With this invention, the camshaft 32 axis of rotation is spaced parallel to the crankshaft axis of rotation.

Two separate housing mating plates of similar structure, an intake housing mating plate 44, and an exhaust housing mating plate 54, are configured to enclose the intake valve plate 46 and exhaust valve plate 56. Both include a central annular bearing 64 and 65, respectively, connected therein to rotatably receive the cam shaft 32 therein. Each of the housing mating plates 44 and 54 has a respective non central port 50 and 60. When the intake housing mating plate 44 connects to the central valve housing 12 in a way that are communicably aligned with the transverse port 18, they collectively create intake flow path into the combustion chamber 24. Similarly, when the exhaust housing mating plates 54 connects to the central valve housing 12 in a way that are communicably aligned with the transverse port 18, they collectively create exhaust flow path out of the combustion chamber 24.

Figure 4:
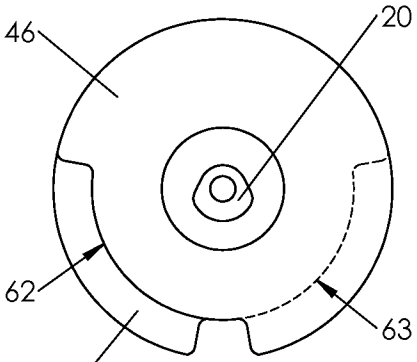
FIG. 4 shows an exemplary timing of the exhaust and intake plate relative to the prototypical cam of the instant invention.

To describe the timing sequence of the intake and exhaust flow, as shown in FIG. 7 A-D, start with the piston 28 positioned at 90 degrees before the upper end of the cylinder 26, commonly refer as top dead center. In this piston 28 position, as shown in FIG. 7A, the poppet valve 36 is open to exhaust the combusted gases out of the chamber 24. At this time in the cycle, the exhaust plate valve 56 is open to clear the exhaust gases out of the transfer port 18. The intake plate valve 46 is closed to prevent any exhaust transfer to the intake duct 50. As shown in FIG. 7B, the intake plate opens to start intake flow and to assist the exhaust evacuation from the transfer port 18. As it is shown in FIG. 4, there is an overlap between the intake plate 46 opening 62 (opening position) and exhaust plate 56 opening 63 (closing position) to completely clear the exhaust out of the combustion chamber 24 and the transfer port 18. The flow and the position of the plate valves 46 and 56 and the poppet valve 36 during this cycle are seen in FIG. 7B.

Figure 7B:
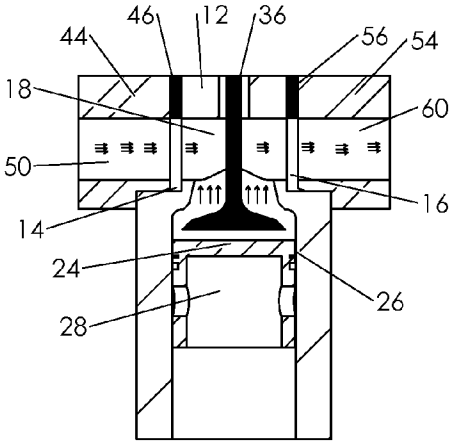
FIG. 7B is fragmented view showing the poppet and plate valve positions during end of an exhaust cycle, the poppet valve remains open and intake plate opens through open exhaust plate to allow the exhaust to fully evacuate an exhaust operation cycle of the engine.
Figure 7D:
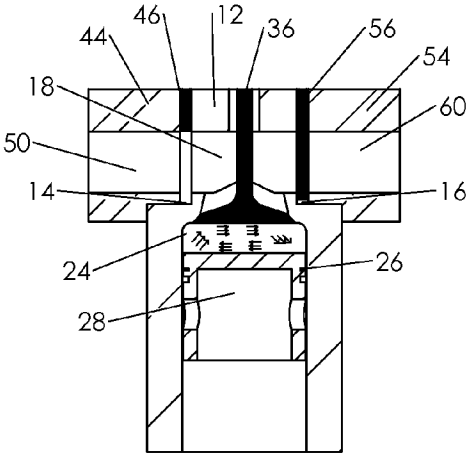
FIG. 7D is fragmented view showing the poppet and plate valve positions during a compression power phase operation cycle of the engine.
Figure 7A:
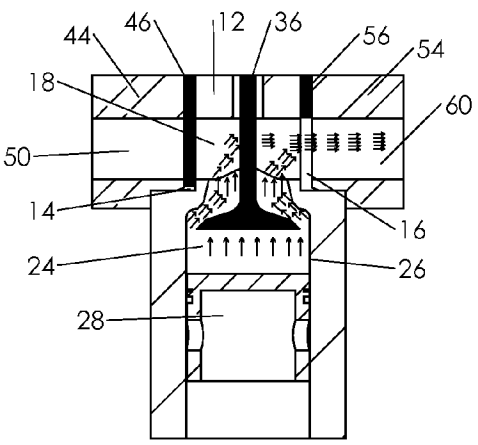
FIG. 7A—is fragmented view showing the poppet and plate valve positions during end of a power phase operation cycle of the engine with an exhaust plate open.
Figure 7C:
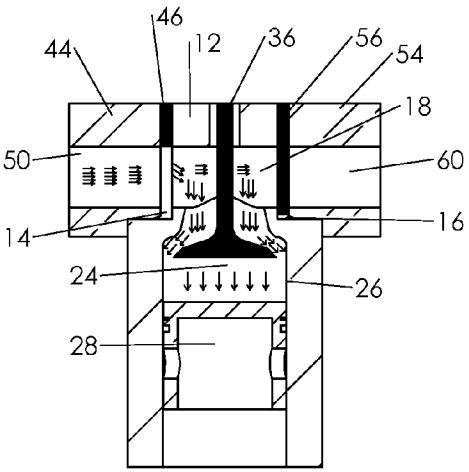
FIG. 7C is fragmented view showing the poppet and plate valve positions during an intake operation cycle of the engine with exhaust plate closed.

As shown in FIG. 7C, intake cool air passes through the intake port 50 into the transfer port 18 and finally to the combustion chamber 24. The expelling of cool air passing the poppet valve 36 and contacting the exhaust plate valve 56 in area of the transfer port 18 reduces the temperature of the components. This cooling effect reduces detonation on the poppet valve 36 and the incidence of nitrogen oxide formation. Consequently, the temperature increase of the intake air help to achieve better combustion characteristics.

The poppet valve 36 starts to close as the volume of air in the combustion chamber 24 reaches a required amount. An amount of fuel is injected into the combustion chamber 24 by conventional means. The piston 28 starts traveling towards top dead center and the charge of air begin to compress. The position of the plate valves 46 and 56 and the poppet valve 36 during this cycle are shown in FIG. 7D. Once compresses, the charge of combustible mixture is ignited in conventional way. Using single poppet type valve system gasoline type of engine, the ideal position of the ignition system is in the center of the poppet valve head 38. For diesel type of engine with single poppet valve system, the ideal location of the fuel injection point is in the center of the poppet valve head 38.

Figure 6:
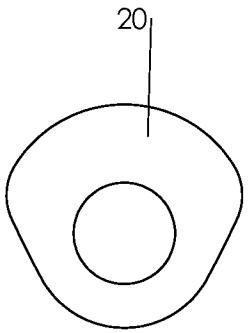
FIG. 6 is a side view of the prototypical cam configuration used for the poppet valve actuation.

The ignition of the combustible mixture produces hot gases of combustion that expand rapidly and push the piston 28 back towards bottom dead center. The poppet valve is valve 36 is sealed during the compression, ignition, and expansion of the combustible mixture, against the valve seat 34. The poppet valve 36 starts to open once the volume of the combustion mixture reaches the maximum. Consecutively, the burnt gases are exhausted through the transfer port 18. The piston 28 returns to the beginning of its cycle at top dead center. The poppet valve 36 is fully open on the exhaust stroke and remains fully open during the air intake stroke and only closes when it is desired to initiate compression, ignition and expansion. This is achieved by using a special cam 20 profile as shown in FIG. 6. The opening and closing position and duration of the poppet valve 36 is determined by the requirement of air and speed of the engine. Since the plate valves 46 and 56 and the poppet valve 36 mechanism follows a traditional cam system, conventional variable valve timing mechanism can be incorporated.

In the embodiment seen in FIG. 8, the engine 10' shows an exemplary alternative design with two poppet valves 36 instead of one, nested within the housing 22. In accordance with the invention, both poppet valves 36 collectively open and close the combustion chamber 24 by means of cam 30 and stay close throughout the combustion and power stroke by means of springs 52. The cam 30 can have exact same timing profile to open and close both poppet valves simultaneously or they can vary slightly depending on the design need. The other operations of engine 10' is similar to engine 10.

In the embodiment seen in FIGS. 9-11, the engine 10" shows an exemplary alternative design using an intake slide valve 70 and exhaust slide valve 80 instead of the rotating plate valves 46 and 56. In accordance with the invention, plate valves 70 and 80 open and close the intake and exhaust duct 50 and 60 respectively by means of cams 72 and 82 and stay close throughout the compression, ignition, and expansion strokes by means of springs 78. In this embodiment, the intake housing mating plate 74 and the exhaust housing mating plate 84 are configured with opening 76 and 86, respectively to house the cam and spring actuating mechanism. The actuation mechanism is typical of cam actuation mechanism and allows the flexibility of incorporating variable valve timing if desired.

The automotive industry is under mandates to increase the fuel efficiency of the internal combustion engine. The purpose of the instant invention design is to develop an engine that has higher fuel efficiency while maintaining the power output. One way of achieving this would be increasing the engine's thermal and volumetric efficiency. Our analysis suggest that using single poppet type valves to control the air in and out of the cylinder through the transfer port will significantly increases the engines volumetric efficiency.

For both instance of single or multiple poppet valves, where the poppet valves open and close collectively, the exhaust evacuates much more efficiently while the poppet valve stays open for longer period of time. In conventional engine the exhaust valve starts to close about 60 degrees before the intake starts to open leaving some exhaust gas in the cylinder. When a single poppet valve or multiple poppet valves are used collectively, the system increases the air flow area for the exhaust, thus overcoming the normal situation where the exhaust valves are generally smaller than the intake, which is a limiting factor of efficiently exhausting the combusted gases. The benefit of a single valve design is that it creates a chamber that is more hemispheric and the intake charge has high swirl to initiate better combustion.

When complete exhaust is desired, the intake plate valve can open slightly before the exhaust plate valve closing so there is an overlap of flow between the intake and the exhaust duct. The incoming fresh air scoops out any remaining exhaust in the combustion chamber through the transfer port and out through the exhaust. Alternatively, to control the nitrogen oxide formation, it is sometime desirable to have some exhaust gas inside the combustion chamber. Separate intake and exhaust control and the ability to vary the timing make it easier to achieve that. Using the plate type valve in the intake and exhaust duct, the timing can be varied so the exhaust closes before the intake opens and thus some of the intake air gets mixed with the exhaust gas trapped in the transfer port.

The above described embodiments are set forth by way of example and are not for purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

We claim:

1. A flow control mechanism for an internal combustion reciprocating piston engine comprising;

a combustion chamber;

a common transfer port adjacent said combustion chamber and running normal to said combustion chamber;

an intake duct directly communicating with said transfer port and an exhaust duct extending out from said transfer port to communicate flow into and out of said transfer port;

a first valve positioned inside said combustion chamber for controlling flow between said transfer port and said combustion chamber;

a second valve for controlling flow between said intake duct and said transfer port; and a third valve for controlling flow between said exhaust duct and said transfer port, wherein said second valve and said third valve are independently controlled, wherein said first valve, said second valve and said third valve open and close communication to a common portion of said transfer port and through said common portion intake as and exhaust gas pass.

2. The engine of claim 1, wherein said first valve is a poppet valve to create positive sealing.

3. The engine of claim 1, wherein said second and third valves are plate valves which are movable independently between a closed position and an open position to control flow into and out of the said transfer port.

4. The engine of claim 3, wherein said plate valves include a semicircular rotary plate.

5. The engine of claim 3, wherein said plate valves include a reciprocating plate.

6. The engine of claim 1, which includes a piston in said combustion chamber which pushes exhaust gas out of said combustion chamber to said transfer port.

7. The engine in claim 1, wherein said exhaust duct directs exhaust air out of said transfer port while said first valve and said third valve are in an open position and said second valve is in a closed position.

8. The engine of claim 1, wherein after exhaust occurs in said engine, said first valve remains open and said second valve starts to open to allow exhaust to fully evacuate said combustion chamber.

9. The engine of claim 1, wherein said intake duct and said exhaust ducts are communicably independent of said first valve position.

10. The engine of claim 1, which includes a control mechanism for said first valve, said second valve, and said third valve which are operable from a single axle.

* * * * *